US007011573B2

(12) United States Patent
McArthur et al.

(10) Patent No.: US 7,011,573 B2
(45) Date of Patent: Mar. 14, 2006

(54) DRYWALL SANDING APPARATUS

(76) Inventors: Richard C. McArthur, 38479 N. Third Ave., Spring Grove, IL (US) 60081; Dennis G. Holmes, 4837 Blossum Ct., Waukegan, IL (US) 60087; Ronald J. McArthur, 42 Wildwood Trail, Cary, IL (US) 60013

( * ) Notice: Subject to any disclaimer, the term of this patent is extended or adjusted under 35 U.S.C. 154(b) by 0 days.

(21) Appl. No.: 10/848,230

(22) Filed: May 18, 2004

(65) Prior Publication Data

US 2004/0259488 A1 Dec. 23, 2004

Related U.S. Application Data

(60) Provisional application No. 60/474,052, filed on May 29, 2003.

(51) Int. Cl.
*B24D 15/00* (2006.01)

(52) U.S. Cl. ..... 451/523; 451/525; 451/512

(58) Field of Classification Search ..... 451/523–525, 451/512, 520, 521, 557, 354; 15/244.1, 244.4
See application file for complete search history.

(56) References Cited

U.S. PATENT DOCUMENTS

| | | | | | |
|---|---|---|---|---|---|
| 3,850,533 | A * | 11/1974 | Thielen | 403/58 |
| 4,023,312 | A * | 5/1977 | Stickney | 451/557 |
| 4,885,876 | A | 12/1989 | Henke | |
| 5,895,316 | A * | 4/1999 | Williams | 451/524 |
| 5,954,571 | A | 9/1999 | Case | |
| 6,095,911 | A | 8/2000 | Edens | |
| 6,227,959 | B1 | 5/2001 | Beaudry | |
| 6,325,708 | B1 | 12/2001 | Miles | |
| 6,379,237 | B1 | 4/2002 | Gordon | |
| 6,524,175 | B1 | 2/2003 | Beaudry et al. | |
| 6,616,519 | B1 * | 9/2003 | Mansfield | 451/512 |

* cited by examiner

*Primary Examiner*—Dung Van Nguyen
(74) *Attorney, Agent, or Firm*—Cardinal Law Group

(57) ABSTRACT

The drywall sanding apparatus provides a tool assembly for finishing drywall preparation for paint or wallpaper. The apparatus comprises an attachment device for attachment of an abrasive sponge and at least one fastening member for holding the abrasive sponge to the attachment device. The fastening member includes an insertion portion for penetrating into an abrasive sponge to hold the attachment device adjacent the sponge during operation of the sanding device.

11 Claims, 9 Drawing Sheets

100

200

DRYWALL SANDING APPARATUS

RELATED APPLICATION

This application claims priority to U.S. Provisional Application No. 60/474,052, "Drywall Sanding Apparatus" to Richard C. McArthur, et al., filed May 29, 2003, the entirety of which is incorporated by reference.

TECHNICAL FIELD OF THE INVENTION

This invention relates to sanding tools and more specifically to a sponge sanding apparatus for sanding drywall.

BACKGROUND OF THE INVENTION

Typically, interior walls of houses and other types of buildings are composed of a product commonly referred to as drywall. Drywall has largely replaced the use of plaster and lathing to provide a finished surface for walls. Drywall is made in sheets that are approximately four feet by eight feet in size. These sheets are attached to wood or metal frames to form interior walls. After installation, joints or seams are created between each sheet of drywall, necessitating the need to cover the seams with a compound that will make the wall look as if it is a seamless flat surface of the type once obtained using plaster and lathing construction. Generally, the compound is a water based material that is applied wet to the drywall to fill in any gaps and smooth out the seams between the drywall sheets. Once dry, the compound is sanded smooth and, generally, after repeated applications of the compound and sanding, the seams between the drywall sheets are unnoticeable.

In an average sized house, sanding the compound smooth is often labor intensive and time consuming. The procedure usually involves repeated applications of the compound and sanding before a finished wall is obtained and ready for painting or wallpaper. During this process, a sanding tool having a sanding surface is used. Generally, sand paper or a sanding sponge is used as the sanding surface. Whether sand paper or a sanding sponge is used, the sanding surface is worn away and must, therefore, be replaced in order to complete the job. Some of the commercially available sanding sponges have sanding abrasive on more than one surface. However, current sanding tools take advantage of only one of these surfaces due to the method of attachment of the sponge to the sanding tool. The use of only one sanding surface increases the cost of performing the job due to the increased number of sponges needed to do the work.

Additionally, many of the tools devised to hold sand paper and sponges require significant amounts of time to remove the old paper or sponge and replace it with new paper or sponge. The time it takes to change the sponge decreases the efficiency of the person performing the sanding, thereby increasing the cost of performing the job.

Another problem with currently available sanding tools is that they often require a specific type of sanding sponge that fits only that particular sanding tool. This arrangement also increases the cost of sanding the drywall.

Still other sanding tools are awkward to use because they do not provide the user with a full range of motion about a 360 degree area making it difficult to sand in a circular motion or a side-to-side motion.

It would be desirable, therefore, to provide a drywall sanding tool that overcomes these and other disadvantages.

SUMMARY OF THE INVENTION

The present invention provides a device for sanding drywall. The sanding device comprises an attachment device and at least one fastening member. The fastening member includes an insertion portion for penetrating into an abrasive sponge to hold the attachment device adjacent the sponge during operation of the sanding device.

The present invention also provides a method of attaching a sanding sponge to an extension pole. The method comprises positioning an attachment device adjacent one side of a sanding sponge, inserting at least one fastening member through at least one opening formed in the attachment device, rotating the fastening member to drive an insertion portion of the fastening member into the sponge and contacting an outer portion of the fastening member against an outer portion of the attachment device.

These and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DESCRIPTION OF THE DRAWINGS

FIG. 8A to 11B illustrate alternative embodiments of fastening members of the drywall sanding tool is a perspective view of the elongate member of the drywall sanding tool shown in FIG. 1;

DETAILED DESCRIPTION OF THE PRESENTLY PREFERRED EMBODIMENTS

Figure 1:
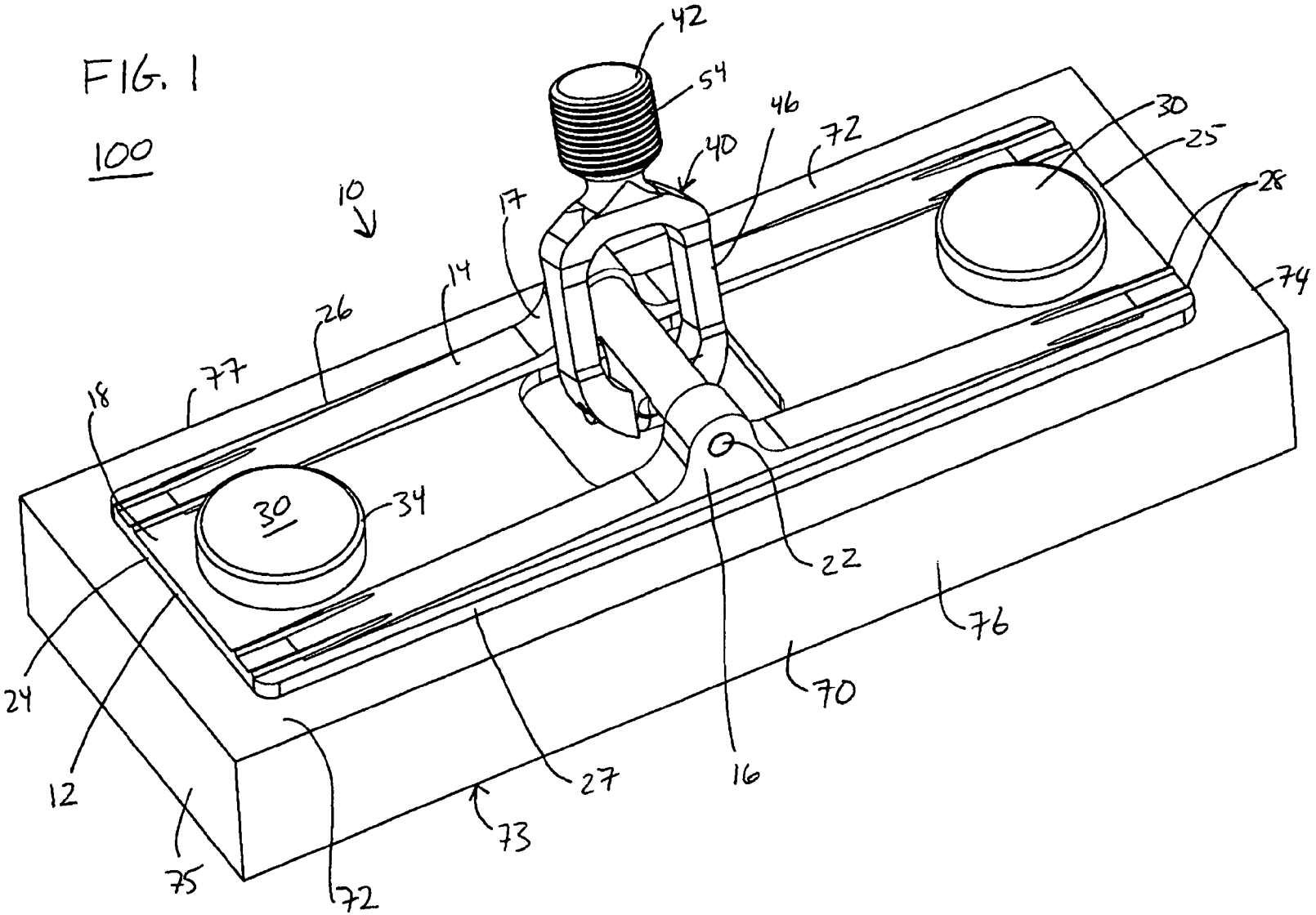
FIG. 1 is a perspective view of an exemplary embodiment of a drywall sanding tool, according to the present invention.
Figure 2:
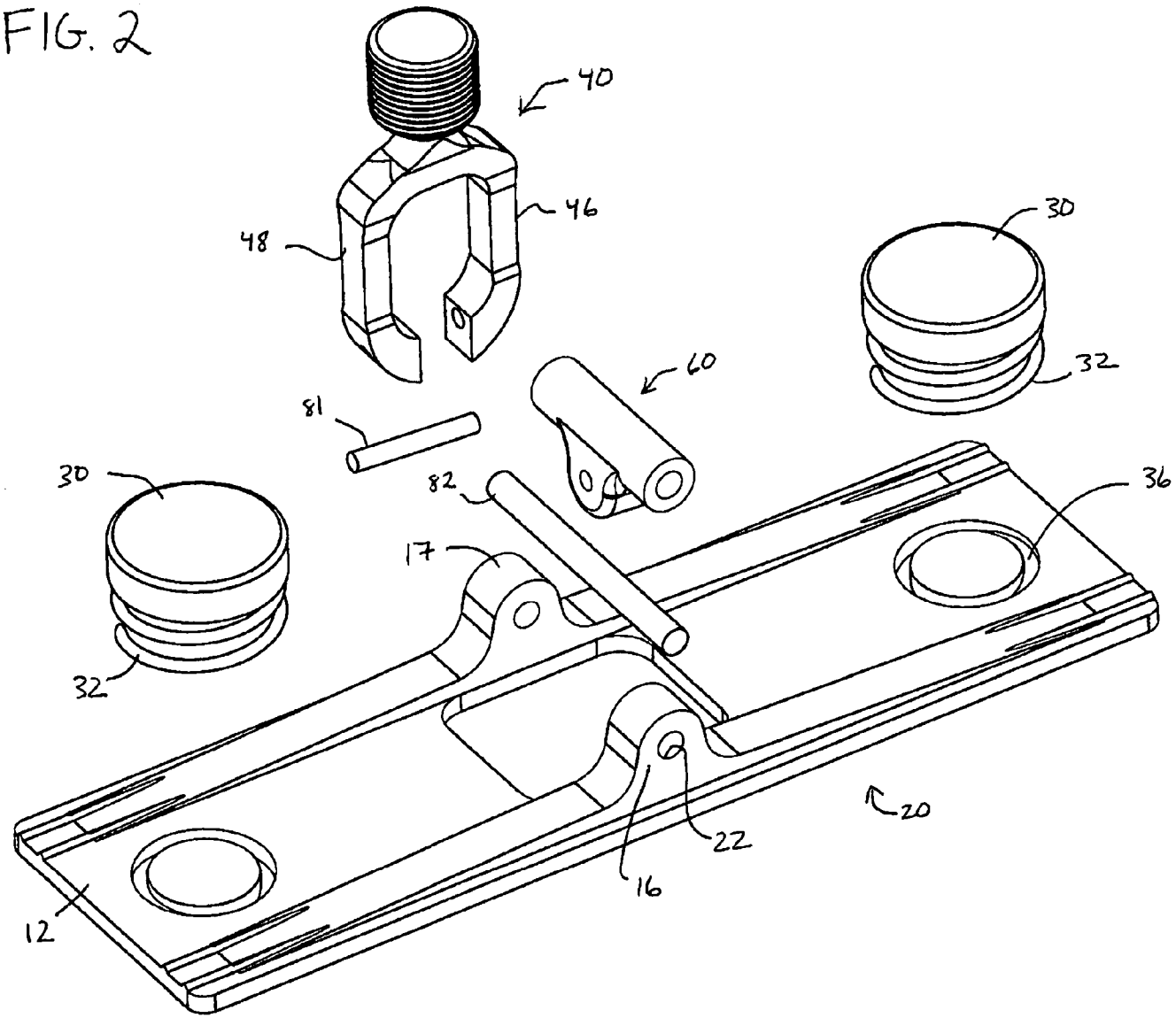
FIG. 2. is an exploded view of the drywall sanding tool shown in FIG. 1.
Figure 3:
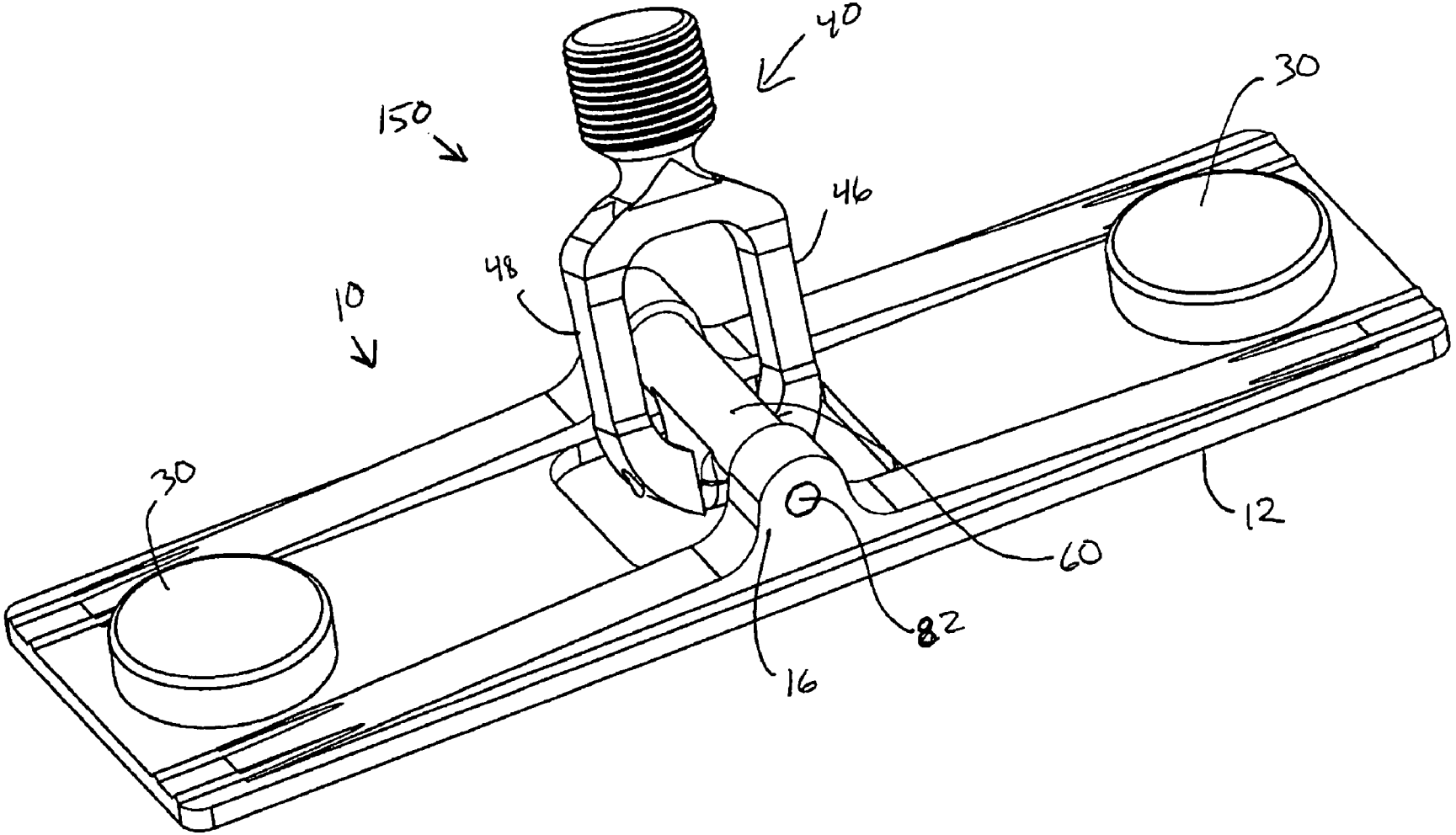
FIG. 3 is a perspective view of the attachment device illustrated in FIG. 1.

FIGS. 1 to 6 illustrate one embodiment of the drywall sanding tool 100 in accordance with the present invention. Dry wall sanding tool 100 includes abrasive portion (sponge or sanding sponge) 70, attachment device 10 and at least one fastening member 30.

Sponge 70 is an abrasive dry wall sanding sponge well known in the art. In one embodiment, sponge 70 is a foam sponge having an abrasive coating of aluminum oxide mineral. Sponge 70 includes at least one abrasive surface. In the preferred embodiment, sponge 70 is a generally rectangular block form with each of its six surfaces 72–77 having an abrasive coating. In use, each of the six surfaces may be used to sand the drywall.

Attachment device 10 is removeably connected to sponge 70 using at least one fastening member 30. Attachment device 10 includes base portion 12 and swivel assembly 150.

Base portion 12 may be composed of metal, metal alloy, plastic or other composites well known in the art sufficient to provide a base suitable for attaching an abrasive sponge. Preferably, base portion 12 is made of a lightweight material. In one embodiment, base portion 12 is composed of aluminum. In one embodiment, base portion 12 includes a plurality of ribs 28. Ribs 28 provide rigidity to base portion 12.

Figure 6:
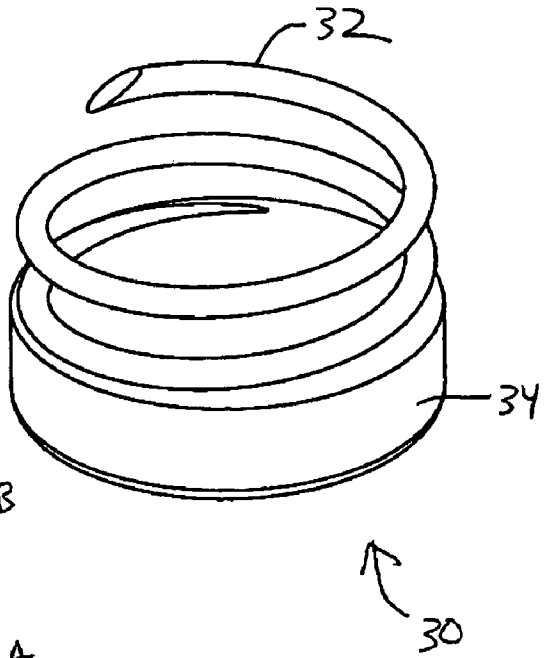
FIG. 6 is a perspective view of the fastening member of the drywall sanding tool shown in FIG. 1.

Base portion 12 includes at least one opening 36. Opening 36 extends through base portion 12 from a first (top) surface 18 of base portion 12 to a second (bottom) surface 20 of base portion 12. In one embodiment, base portion 12 includes two openings 36, one opening 36 positioned adjacent end 24 and another opening 36 positioned adjacent end 25. Those with skill in the art will recognize that openings 36 may be positioned at other locations on base 12. Openings 36 are fashioned to allow a penetrating (insertion) portion 32 of fastening member 30 to pass through base portion 12 and penetrate sponge 70. In one embodiment, openings 36 are helical to allow passage of a helically shaped penetrating portion 32 as shown in FIG. 6. Those skilled in the art will recognize that there are many other variations possible for the fastening member 30 and corresponding opening 36.

Base portion 12 also includes pivot support 14. Pivot support 14 may be integrally formed with base portion 12 or may be fashioned separately and securely attached to base portion 12. Pivot support 14 includes spaced apart shoulders 16, 17. One shoulder 16 is positioned adjacent edge 26 and another shoulder 17 is positioned adjacent edge 27. Each shoulder 16, 17 includes a shoulder opening 22 for receiving a pin 82. Pin 82 extends from shoulder 16 to shoulder 17 providing an attachment for swivel assembly 150.

Swivel assembly 150 provides a swiveling connection between base portion 12 and a removeably attached handle. Swivel assembly 150 includes knuckle portion 40 and swivel 60.

Knuckle portion 40 includes handle attachment portion 42 and arms 46, 48. In one embodiment, handle attachment portion 42 includes threaded surface 54 for threaded attachment of a handle (not shown). The handle may be a standard extension pole, a short handle or any other handle device, as are well known in the art, suitable for providing a grip during operation of the sanding device 100. In another embodiment, the knuckle portion may include a female threaded opening for receiving a male threaded handle or extension pole.

Figure 5:
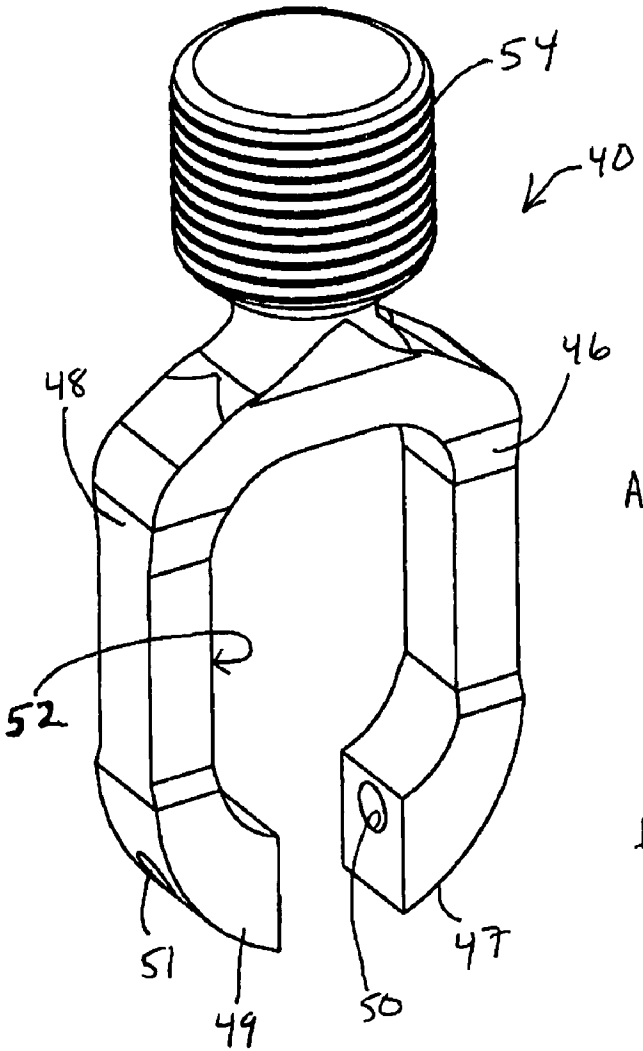
FIG. 5 is a perspective view of the knuckle portion of the drywall sanding tool shown in FIG. 1.

Arms 46, 48 of knuckle portion 40 form a general "C" shape as is best illustrated in FIG. 5. Each arm 46, 48 includes a distal end 47, 49, respectively. Each distal end 47, 49 includes a pin opening 50, 51 defined therethrough.

Swivel 60 includes an elongate portion 62 and an arm attachment portion 66. Elongate portion 62 includes opening 64 for receiving a pin 82. Elongate portion 62 is sized to span the distance between shoulders 16, 17 of base portion 12. Arm attachment portion 66 includes an opening 68 for receiving a pin 81. Arm attachment portion 66 is sized to span the gap between the distal ends 47, 49 of arms 46, 48 when assembled. Arms 46, 48 of knuckle portion 40 further define a generally circular opening 52 for receiving elongate portion 62 of swivel 60.

Figure 4:
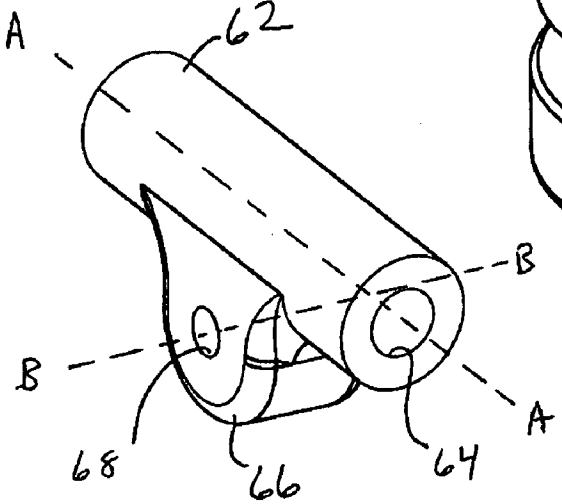
FIG. 4 is a perspective view of the elongate member of the drywall sanding tool shown in FIG. 1.

When assembled, openings 50, 51 of arms 46, 48 align with opening 68 of arm attachment portion 66. The alignment of openings 50, 51 and 68 allow the placement of pin 81 providing rotatable engagement between elongate portion 62 and knuckle portion 40. Properly placed, knuckle portion 40 will rotate about axis B—B as shown in FIG. 4.

The attachment of knuckle portion 40 to swivel 60 positions the elongate member 62 within the opening 52 defined by arms 46, 48 of knuckle 40. In the preferred embodiment, this arrangement provides a low pivot point during operation of the sanding device 100 allowing for a greater range of motion for the device. Consequently, this greater range of motion allows the user to be more efficient in performing the sanding operation.

During assembly, the elongate portion is positioned between the shoulders 16, 17 of base portion 12. Further, opening 64 of elongate portion 62 is aligned with shoulder openings 22. Once aligned, pin 82 is placed for rotatable attachment of elongate portion 62 in relation to base portion 12. Elongate portion 62 rotates about axis A—A as shown in FIG. 4.

Referring to the embodiment illustrated in FIGS. 1 to 6, in practice, the user places an abrasive sponge adjacent bottom surface 20 of base portion 12. Next, the user inserts a fastening member 30 into opening 36 of the base portion 12 and turns the fastening member 30 to allow the sponge penetrating portion 32 to penetrate the sponge 70. The user would turn the fastening member 30 until the fastening member 30 is securely seated against bottom surface 20 of the base portion 12. After a period of use the user may then disengage the sponge from the attachment device 10 by turning the fastening member 30 in the opposite direction from attachment. Then the user may turn the sponge over and reattach the base portion 12 in the same manner as above. Likewise, after use of both surfaces 72, 73 of a single sponge 70, the user may remove the old sponge and attach a new sponge.

Figure 7:
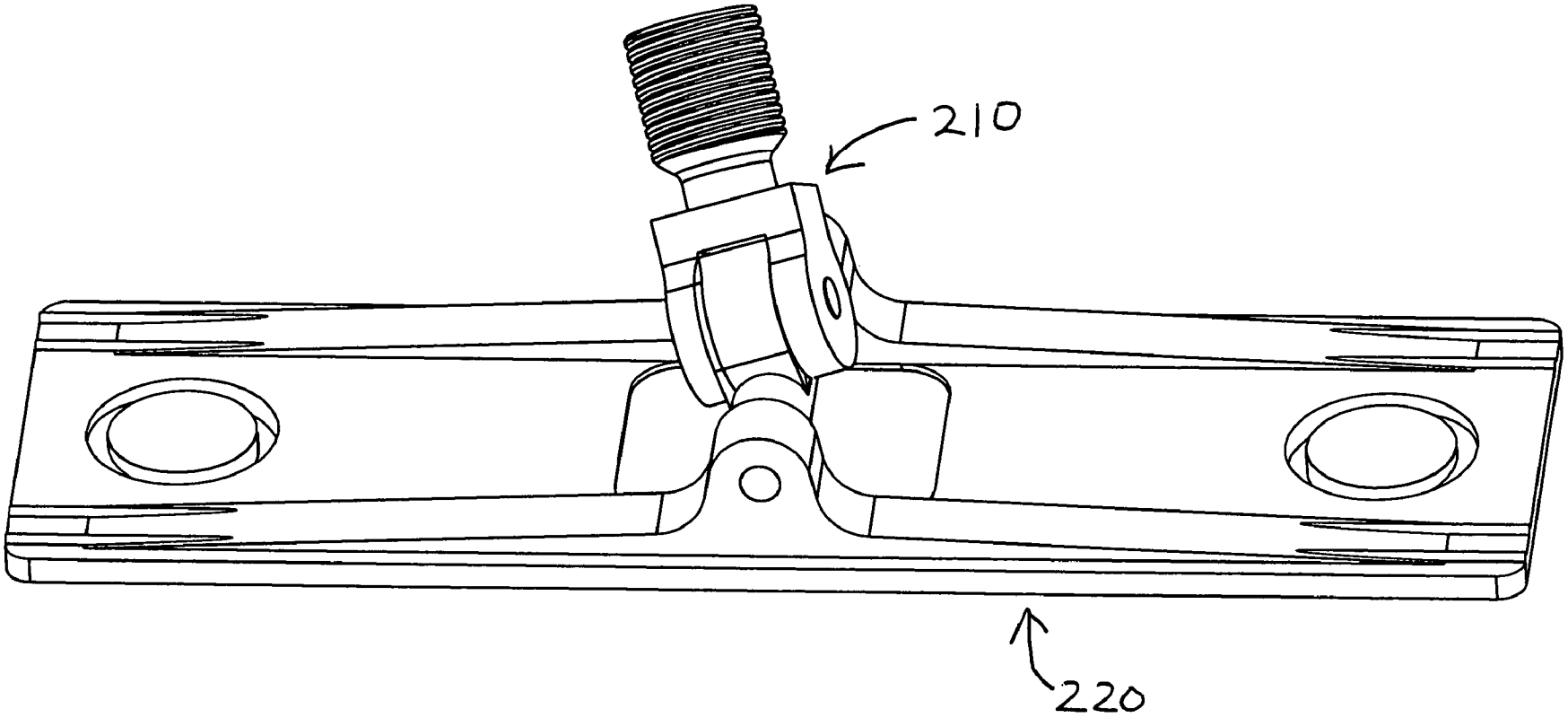
FIG. 7 is another exemplary embodiment of the drywall sanding tool, according to the present invention.

FIG. 7 illustrates another embodiment of attachment device 200 according to the present invention. Attachment device 200 is similar to attachment device 10 described above. However, attachment device 200 uses a universal joint 210 for attachment of a handle to the base portion 220. Further, the attachment device and the fastening member are formed as a unitary member.

FIGS. 8A to 10B illustrate alternative embodiments of an attachment device in accordance with the present invention.

Figure 8A:
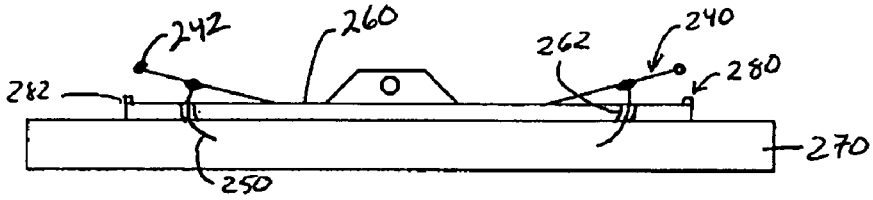
Figure 8B:
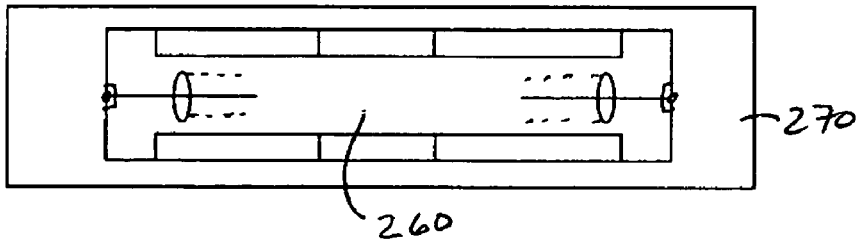

FIGS. 8A and 8B illustrate another embodiment of a fastening member 240. Fastening member 240 includes a two-pronged curved penetrating portion 250 for securing a sponge 270 to a base portion 260. FIGS. 8A and 8B further illustrate a locking mechanism 280 for locking the fastening member 240 in place once the sponge is secured. Locking mechanism 280 includes a clamp 282 for receiving an end 242 of fastening member 240. Clamp 282 is secured to base portion 260. Base 260 includes slightly curved openings 262 for receiving the curved penetrating portions 250 of fastening member 240.

Figure 9A:
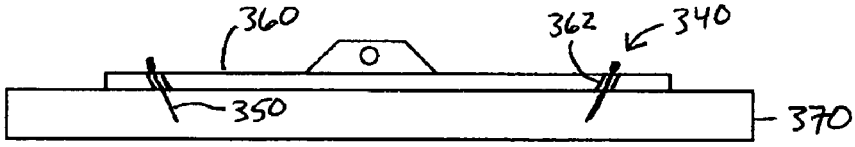
Figure 9B:
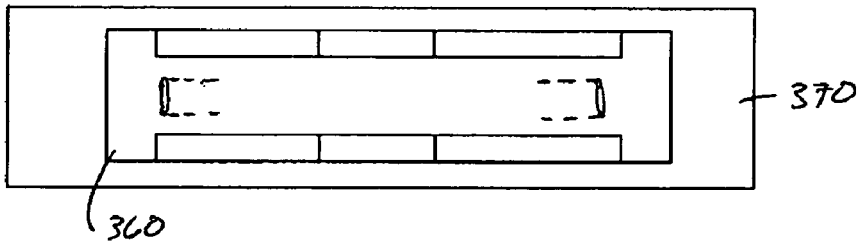

FIGS. 9A and 9B illustrate another embodiment of a fastening member 340. Fastening member 340 includes a two-pronged penetrating portion 350 for securing a sponge 370 to a base portion 360. Base 360 includes openings 362 for receiving the penetrating portions 350 of fastening member 340.

Figure 10A:
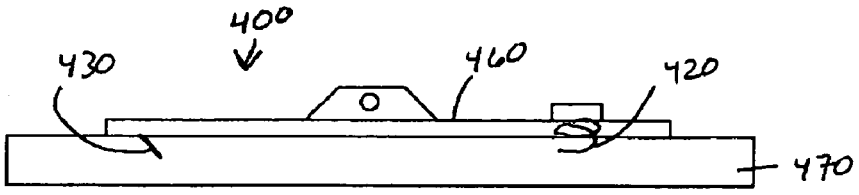
Figure 10B:
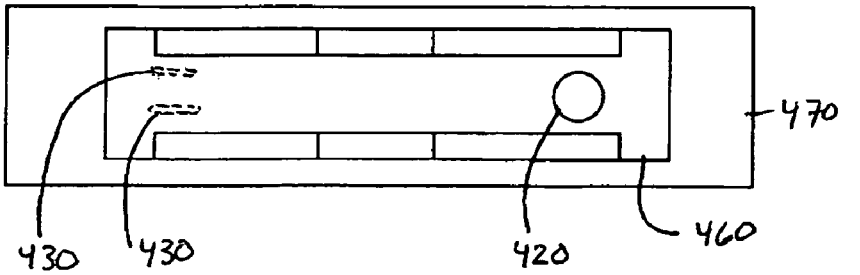

FIGS. 10A and 10B illustrate another embodiment of an attachment device 400 made in accordance with the present invention. Attachment device 400 includes a helical penetrating member 420 such as that described above in relation to FIGS. 1–7 for securing a base portion 460 to sponge 470. Attachment device 400 further includes at least one penetrating member 430 integrally formed with base portion 460. In the embodiment shown in FIGS. 10A and 10B and best seen in FIG. 10B, attachment device 400 includes two penetrating members 430 positioned in a spaced-apart manner on an end opposite the helical penetrating member 420. Penetrating member 430 extends from the bottom surface of base portion 460 for penetrating attachment of sponge 470. In practice, the user would secure the sponge to base portion 460 by first penetrating the sponge with penetrating members 430 then, second, would attach the helical penetrating member to the sponge in a manner similar to that described above.

Figures 11A, 11B:
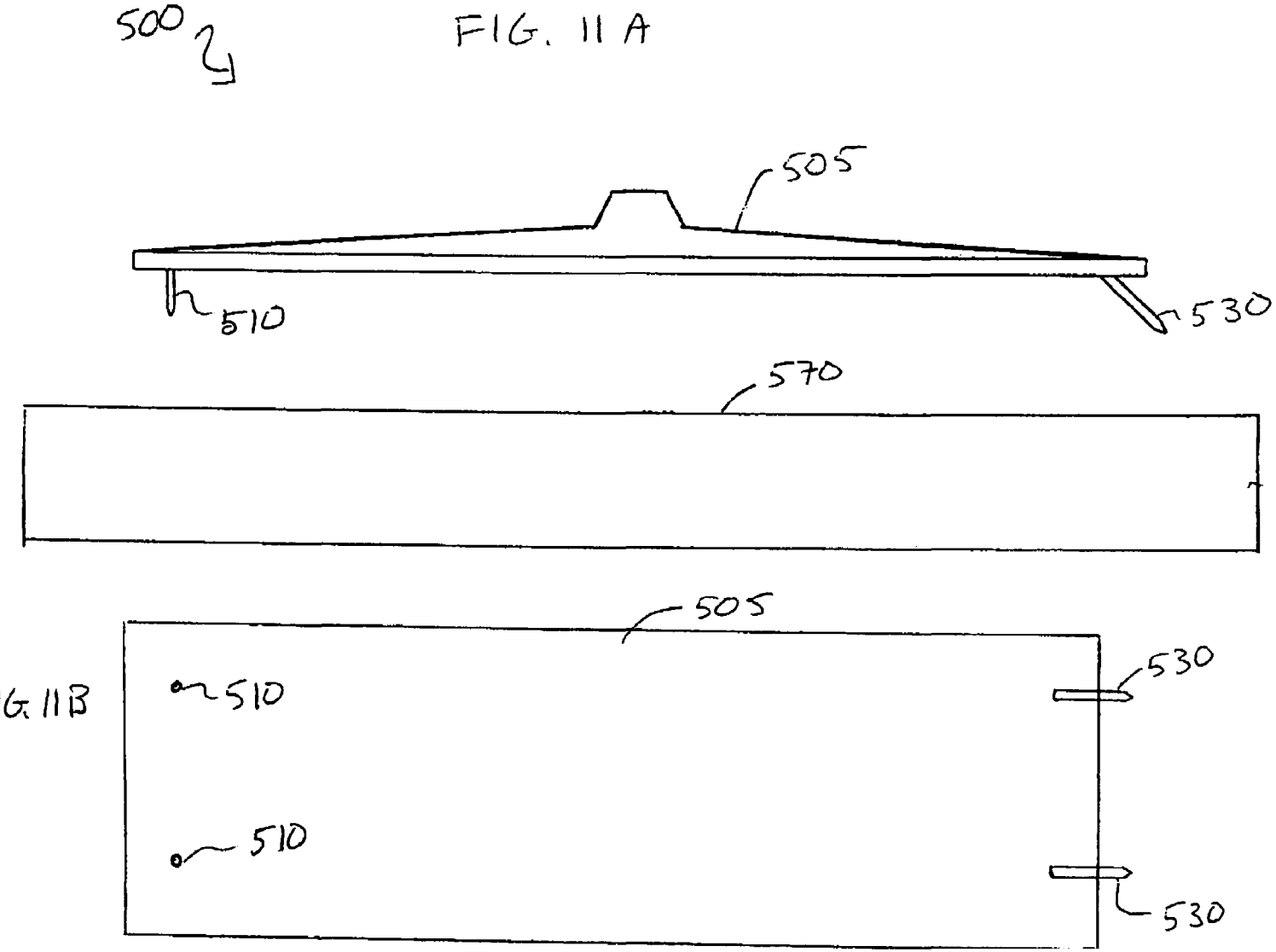

FIGS. 11A and 11B illustrate another embodiment of the sanding tool 500, in accordance with the invention. In this embodiment, sponge penetrating members 530, 510 are formed integrally with the base portion 505 of attachment 500. Base portion 505 includes two each of penetrating member 530 and 510 positioned at opposing ends of base portion 505. In practice the user would first insert penetrating members 530 into the sponge 570 followed by penetrating members 510. Those skilled in the art will recognize that there are many variations to this embodiment. The position and number of the penetrating members may be varied to provide secure attachment of a variety of abrasive sponges well known in the art.

Figure 12:
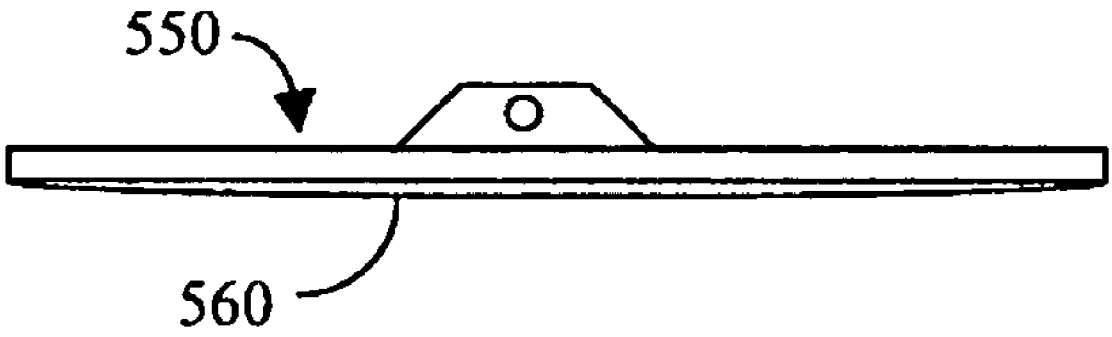
FIG. 12 illustrates another embodiment of a drywall sanding tool, according to the present invention.

In yet another embodiment illustrated in FIG. 12, the base portion 550 of the attachment device has an arched bottom surface 560. The arched surface would provide a slight curve to the attached sponge allowing for the sanding of curved walls. In another embodiment, the base portion of the attachment device has a convex bottom surface. The convex surface would provide a slight curve to the attached sponge allowing for the sanding of curved walls.

Figure 13:
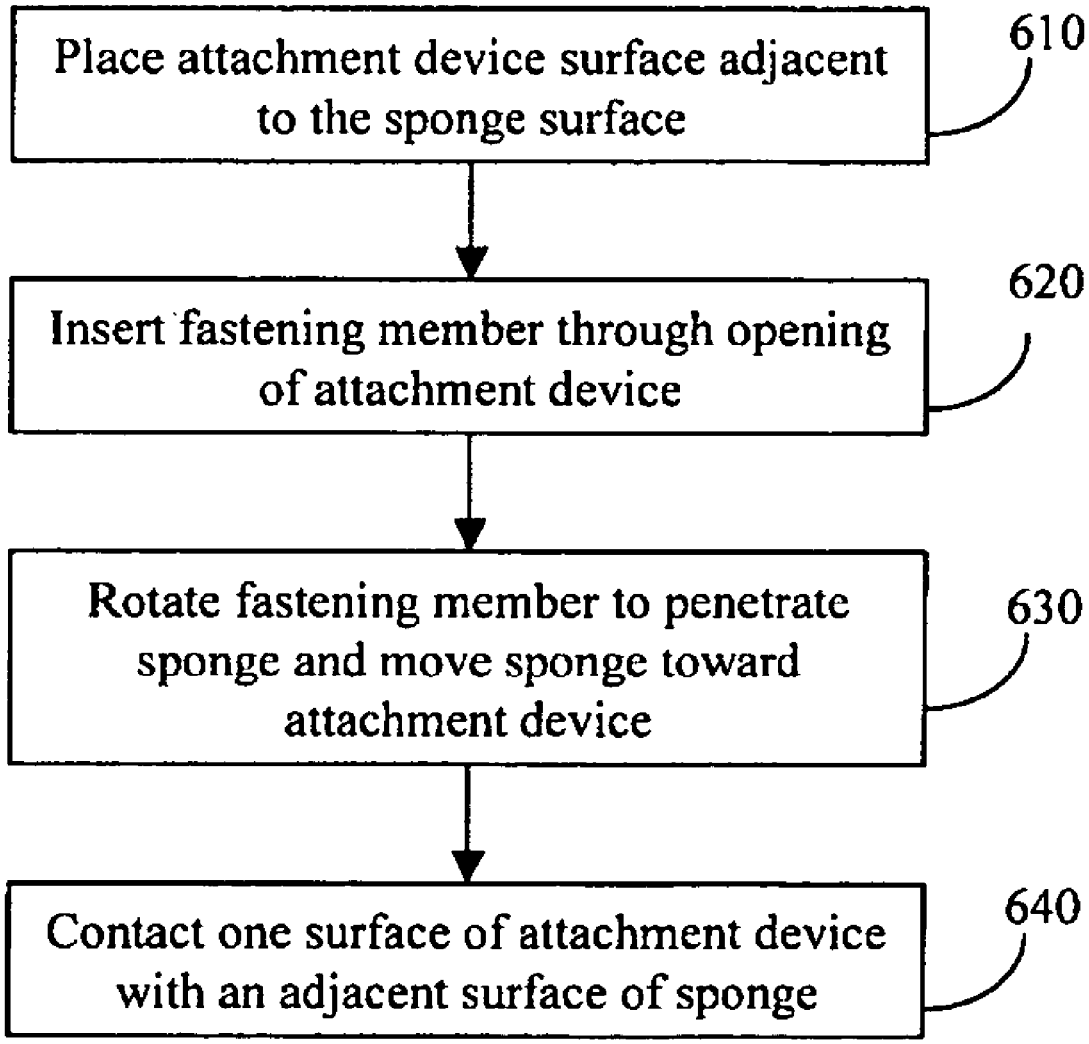
FIG. 13 is a flow chart of a method of attaching an abrasive sponge to a handle, according to the present invention.

FIG. 13 is a flow chart of a method 600 for attaching an abrasive sponge to a handle, according to the present invention. The method begins with a user positioning the bottom surface of an attachment device adjacent one side (the "top" side) of a sanding sponge (Block 610). Next, the user begins to attache the sponge by inserting at least one fastening member through at least one opening formed in the attachment device (Block 620 and then rotating the fastening member to drive an insertion portion of the fastening member into the sponge (Block 630). The method continues by contacting an outer portion of the fastening member against an outer portion of the attachment device (Block 640).

While the embodiments of the present invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A sanding device, comprising:

an attachment device; and at least one fastening member, wherein the fastening member includes an insertion portion for penetrating into an abrasive sponge to hold the attachment device adjacent the sponge during operation of the sanding device, wherein the attachment device has at least one fastener opening formed therein, and wherein the fastener member includes an outer portion to hold the attachment device in place when the insertion portion is pressed through the opening and into the sponge.

2. The device of claim 1 wherein the outer portion of the fastener member comprises a twist grip.

3. The device of claim 1 wherein the insertion portion of the fastener member comprises a helical penetrating member.

4. The device of claim 3 wherein the fastener opening comprises a helical opening for receiving the helical penetrating member.

5. The device of claim 1 further comprising a swivel attachment attached to the attachment device.

6. The device of claim 5 wherein the swivel attachment comprises a swivel portion and a knuckle portion, the swivel portion operably connected to the knuckle portion.

7. The device of claim 6 wherein the knuckle portion includes a handle attachment portion.

8. The device of claim 6 wherein the knuckle portion comprises a first arm having a first distal end with a first arm opening defined there through and a second arm having a second distal end with a second arm opening defined there through.

9. The device of claim 6 wherein the swivel portion comprises an elongate portion having an elongate opening defined along an axis of the elongate portion and an arm attachment portion having a pin opening defined there through, the pin opening for receiving a pin.

10. A method of attaching a sanding sponge to an extension pole, the method comprising:

positioning an attachment device adjacent one side of a sanding sponge;

inserting at least one fastening member through at least one opening formed in the attachment device;

rotating the fastening member to drive an insertion portion of the fastening member into the sponge;

contacting an outer portion of the fastening member against an outer portion of the attachment device.

11. The method of claim 10 further comprising:

engaging an extension pole with a threaded portion of a swivel attachment portion of the attachment member.

* * * * *